US007008193B2

(12) United States Patent
Najafi et al.

(10) Patent No.: US 7,008,193 B2
(45) Date of Patent: Mar. 7, 2006

(54) MICROPUMP ASSEMBLY FOR A MICROGAS CHROMATOGRAPH AND THE LIKE

(75) Inventors: Khalil Najafi, Ann Arbor, MI (US); Hanseup S. Kim, Ann Arbor, MI (US); Luis P. Bernal, Ann Arbor, MI (US); Aaron A. Astle, Ann Arbor, MI (US); Peter D. Washabaugh, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 451 days.

(21) Appl. No.: 10/436,937

(22) Filed: May 13, 2003

(65) Prior Publication Data

US 2003/0231967 A1 Dec. 18, 2003

Related U.S. Application Data

(60) Provisional application No. 60/380,248, filed on May 13, 2002.

(51) Int. Cl.
*F04B 25/00* (2006.01)
*F04B 17/03* (2006.01)

(52) U.S. Cl. ..... 417/244; 417/313; 417/413.3

(58) Field of Classification Search ..... 417/244, 417/313, 413.1, 413.3, 505; 73/19.02
See application file for complete search history.

(56) References Cited

U.S. PATENT DOCUMENTS 4,911,616 A 3/1990 Laumann, Jr.
5,078,581 A 1/1992 Blum et al.
5,180,288 A 1/1993 Richter et al.
5,529,465 A 6/1996 Zengerle et al.
5,822,170 A 10/1998 Cabuz et al.
5,836,750 A 11/1998 Cabuz
5,871,336 A * 2/1999 Young ..... 417/207
5,901,939 A 5/1999 Cabuz et al.
6,071,087 A * 6/2000 Jalink et al. ..... 417/322
6,106,245 A 8/2000 Cabuz
6,168,395 B1 1/2001 Quenzer et al.
6,179,586 B1 1/2001 Herb et al.
6,184,607 B1 2/2001 Cabuz et al.

(Continued)

OTHER PUBLICATIONS

Zengerle, R., et al., Microfluidics, Seventh International Symposium on Micro Machine and Human Science, IEEE, 1996, pp. 13-20.

(Continued)

*Primary Examiner*—Charles G. Freay
(74) *Attorney, Agent, or Firm*—Brooks Kushman P.C.

(57) ABSTRACT

A MEMS-fabricated microvacuum pump assembly is provided. The pump assembly is designed to operate in air and can be easily integrated into MEMS-fabricated microfluidic systems. The pump assembly includes a series of pumping cavities with electrostatically-actuated membranes interconnected by electrostatically-actuated microvalves. A large deflection electrostatic actuator has a curved fixed drive electrode and a flat movable polymer electrode. The curved electrodes are fabricated by buckling the electrode out-of-plane using compressive stress, and the large deflection parallel-plane electrostatic actuators are formed by using the curved electrode. The curved electrode allows the movable electrode to travel over larger distances than is possible using a flat electrode, with lower voltage. The movable electrode is a flat parylene membrane that is placed on top of the curved electrode using a wafer-level transfer and parylene bonding process. Using this approach, large out-of-plane deflection of the parylene membrane is achieved using a voltage smaller than is achievable using flat parallel-plate electrodes.

23 Claims, 9 Drawing Sheets

U.S. PATENT DOCUMENTS

| | | | | |
|---|---|---|---|---|
| 6,184,608 | B1 | 2/2001 | Cabuz et al. | |
| 6,215,221 | B1 | 4/2001 | Cabuz et al. | |
| 6,240,944 | B1 | 6/2001 | Ohnstein et al. | |
| 6,255,758 | B1 | 7/2001 | Cabuz et al. | |
| 6,288,472 | B1 | 9/2001 | Cabuz et al. | |
| 6,328,228 | B1 | 12/2001 | Bossini | |
| 6,351,054 | B1 | 2/2002 | Cabuz et al. | |
| 6,358,021 | B1 | 3/2002 | Cabuz | |
| 6,361,294 | B1 * | 3/2002 | Witzigreuter et al. | 417/413.3 |
| 6,544,655 | B1 | 4/2003 | Cabuz et al. | |
| 2003/0068231 | A1 | 4/2003 | Cabuz et al. | |
| 2003/0194332 | A1 * | 10/2003 | Jahn et al. | 417/395 |

OTHER PUBLICATIONS

Gerlach, Torsten, Pumping Gases By A Silicon Micro Pump with Dynamic Passive Valves, Transducers '97, Proc. International Conference on Micro Electro Mechanical Systems, Chicago, Jun. 16-19, 1997, pp. 357-360.

Van Der Wiingaart, Wouter, et al., The First Self-Priming And Bi-Directional Valve-Less Diffuser Micropump For Both Liquid And Gas, Proc. 13th Annual International Conference On Micro Electro Mechanical Systems, MEMS 2000, 674-679.

Cabuz, Cleopatra, et al., The Dual Diaphragm Pump, Proc. 14th IEEE International Conference on Micro Electro Mechanical Systems, MEMS 2001, pp. 519-522.

Müller, Michael O., et al., Accoustically Generated Micromachined Jet Arrays For Micropropulsion, Proc. 2002 ASME International Mechanical Engineering Congress & Exposition, IMECE 2002-33630.

Chou, Tsung-Kuan A., et al., 3D MEMS Fabrication Using Low-Temperature Wafer Bonding With Benzocyclobutene (BCB), Tranducers 2001, Eurosensors XV, 11th International Conference on Solid-State Sensors and Actuators, Munich, Germany, Jun. 10-14, 2001, pp. 1570-1573.

Legtenberg, Rob, et al., Electrostatic Curved Electrode Actuators, IEEE, 1997, JMEMS, vol. 6, No. 3, pp. 257-265.

Gimkiewicz, Christiane, et al., Fabrication of Microprisms For Planar Optical Interconnections By Use Of Analog Gray-Scale Lithography With High-Energy-Beam-Sensitive Glass, Applied Optics, vol. 38, No. 14, May 10, 1999, pp. 2986-2990.

Chou, Tsung-Kuan A., et al., Fabrication Of Out-Of-Plane Curved Surfaces In Si By Utilizing Rie Lag, *MEMS 20002*, pp. 145-148.

Han, Arum, et al., A Low Temperature Biochemically Compatible Bonding Technique Using Fluoropolymers For Biochemical Microfluidic Systems, MEMS 2000, pp. 414-418.

Su, Yu-Chuan, et al., Localized Plastic Bonding For Micro Assembly, Packaging And Liquid Encapsulation, IEEE 2001, pp. 50-53.

Yang, Eui-Hyeok, et al., A New Wafer-Level Membrane Transfer Technique For MEMS Deformable Mirrors, IEEE 2001, pp. 80-83.

Maharbiz, Michel M., et al., Batch Micropackaging By Compression-Bonded Wafer-Wafer Transfer, IEEE, 1999, pp. 482-489.

Pornsin-Sirirak, Nick, et al., Flexible Parylene-Valved Skin For Adaptive Flow Control, pp. 1-4.

Pornsin-Sirirak, T.N., et al., Flexible Parylene Actuator For Micro Adaptive Flow Control, pp. 1-5.

Wang, Xuan-Qi, et al., A Parylene Micro Check Valve, IEEE 1999, MEMS International Micro Electro Mechanical Systems Conference.

Xie, Jun, et al., Surface Micromachined Leakage Proof Parylene Check Valve, IEEE 2001, pp. 539-542.

Wang, Xuan-Qi, et al., A Normally Closed In-Channel Micro Check Valve, pp. 1-6.

Grosjean, Charles, et al., A Thermopneumatic Peristaltic Micropump, Technical Diges of Transducers '99, Sendai, Japan, pp. 1-4.

Meng, Ellis, et al., A Check-Valved Silicone Diaphragm Pump, pp. 1-6.

Walsh, Ken, et al., Photoresist As A Sacrificial, Layer By Dissolution In Acetone, pp. 1-4.

* cited by examiner

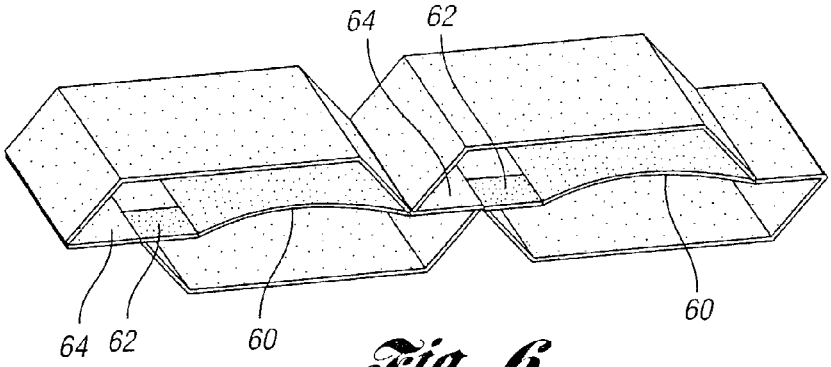
Fig. 6
Fig. 7a
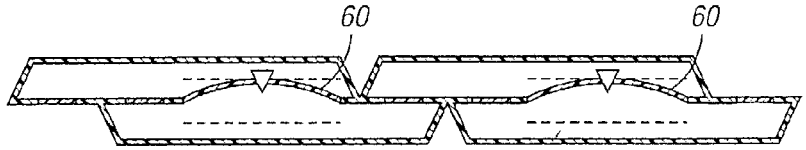
Fig. 7b
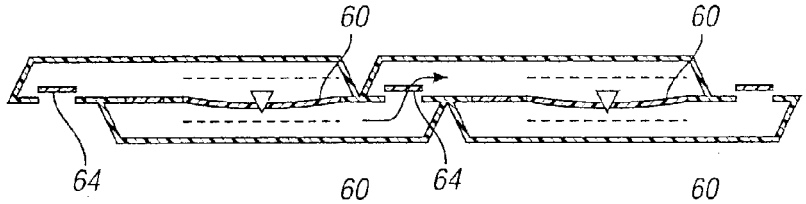
Fig. 7c
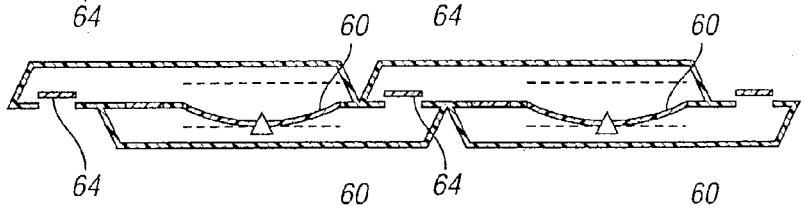
Fig. 7d
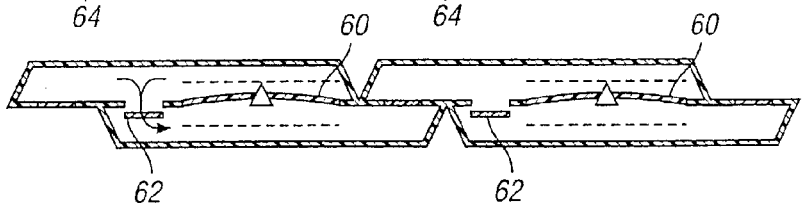
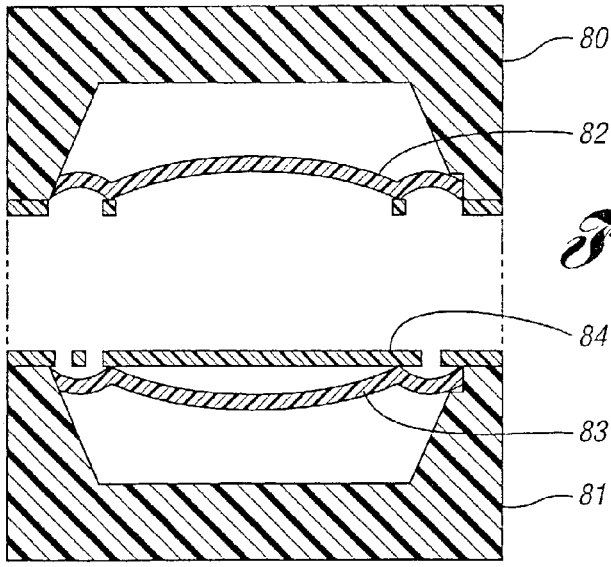
Fig. 8

MICROPUMP ASSEMBLY FOR A MICROGAS CHROMATOGRAPH AND THE LIKE

CROSS-REFERENCE TO RELATED APPLICATION

This application claims the benefit of U.S. provisional application Ser. No. 60/380,248, filed May 13, 2002 and entitled "Micro-Pump Concept."

STATEMENT REGARDING FEDERALLY SPONSORED RESEARCH OR DEVELOPMENT

This invention was made with Government support under Award Nos. EEC-9986866 and EEC-0096866. The Government has certain rights in the invention.

BACKGROUND OF THE INVENTION

1. Field of the Invention

This invention relates to micropump assemblies for microgas chromatographs and the like.

2. Background Art

In the last decade, a large number of micropump designs have been reported in the literature. Zengerle & Sandmaier provide an overview of early developments of micropumps in 1996 *Microfluidics, Proc. Seventh International Symposium on Micro Machine and Human Science*, pp. 13–20, IEEE.

Several trends in the design of micropumps are readily identified in the literature. Actuation is a key element of the pump. For gas pumping applications, electrostatically or piezoelectric driven membranes are frequently used. However, these actuation mechanisms are limited by the volume displacement of the membrane and require high drive voltages. The microvalves needed to control the flow in and out of the pump are another critical part of the design. Although valve-less micropumps have been proposed, these pumps have significantly lower performance than micropumps using check valves, particularly for gas operation as described in Gerlach, "Pumping Gases by a Silicon Micropump with Dynamic Passive Valves," Transducers '97, Proc. International Conference on Solid-State Sensors and Actuators, pp. 357–360 (1997); and Wijngaart et al., "The First Self-Printing and Bi-Directional Valve-less Diffuser Micropump for Both Liquid and Gas," Proc. 13th *Annual International Conference on Micro Electro Mechanical Systems*, MEMS 2000, pp. 674–679.

More recently, Cabuz et al. describe an electrostatically actuated dual-diaphragm gas micropump which integrates the microvalves in the moving diaphragm. Typical performance of these pumps, however, would not meet the requirements of many micro gas chromatographs. Cabuz et al., "The Dual Diaphragm Pump," Proc. 14th IEEE *International Conference on Micro Electro Mechanical Systems*, MEMS 2001, pp. 519–522. In particular, the maximum flow rate required, which could be as high as 50 ml/min at a pressure rise of a few tens of an atmosphere, cannot be obtained with present designs. However, power consumption of electrostatically actuated pumps is comparatively low of the order of a few milliwatts, which is consistent with the power requirements of microgas chromatographs.

There have been a number of recent developments of electrostatically-driven acoustic jet arrays for micro air vehicle propulsion and control. The requirements for the membranes used in the acoustic jet arrays include a large volume displacement and high operating frequency, as described in Müller et al., "Acoustically Generated Micromachined Jet Arrays for Micropropulsion Applications," Proc. 2002 ASME *International Mechanical Engineering Congress & Exposition*, IMECE 2002–33630; and Chou et al., "3D MEMS Fabrication Using Low Temperature Wafer Bonding with Benzocyclobutane," Transducers, 2001.

The following U.S. patent documents are related to the present application: U.S. 2003/0068231 A1; U.S. Pat. Nos. 6,544,655; 6,328,228; 6,358,021; 6,351,054; 6,288,472; 6,255,758; 6,240,944; 6,215,291; 6,184,607; 6,184,608; 6,179,586; 6,168,395; 6,106,245; 5,901,939; 5,836,750; 5,822,170; 5,529,465; 5,180,288; 5,078,581; and 4,911,616.

Recently, efforts to lower operating power or voltage have attracted attention in most MEMS devices as well as other electronic systems. It is especially true for electrostatically-actuated MEMS devices where the operation is controlled by applied voltage. The maximum out-of-plane (vertical) deflection in flat electrostatic electrode actuators is limited by their small gap separation for an acceptable pull-in voltage. In order to achieve an optimized trade-off between parallel-plate deflection and voltage, a diverse and large number of approaches have been pursued. Among them, the concept of curved electrode by Legtenberg offers several benefits. The main idea is that much larger electrostatic forces, due to smaller air gap at the edges, can be obtained when one electrode of the two parallel electrodes is made to be curved. Thus, the flat membrane can be moved to a much larger vertical deflection with a lower voltage because a large force is created around the edges where the two electrodes are closest. Then, a so-called "zipping" effect proceeds to collapse the membrane against the electrode and thereby circumvent high voltages. Therefore, large deflections can be obtained in the middle of the membrane.

In order to apply this electrode concept, fabrication of a curved shape becomes the main challenge. In the past, work has been done to fabricate the lateral curved electrode structure using photolithographic techniques. Also, several efforts have been reported to develop a vertical, out-of-plane, curved surface on silicon wafers.

For example, analog lithography and RIE-lag have been used. These past works were successful in creating curved surfaces. However, the fabrication process for these has typically been too complex.

The following articles are related to the above:

R. Legtenberg et al., "Electrostatic Curved Electrode Actuators," JMEMS, Vol. 6, No. 3, pp. 257–265, 1997;

C. Gimkiewicz et al., "Fabrication of Microprisms for Planar Optical Interconnections by Use of Analog Grayscale Lithography with High-Energy-Beam-Sensitive Glass," APPLIED OPTICS, Vol. 38, No. 14, pp. 2986–2990, 1999; and T-K A. Chou et al., "Fabrication of Out-of-Plane Curved Surfaces in Si by Utilizing RIE Lag," MEMS '02, pp. 145–148, 2002.

Recently, the usage of polymer materials in MEMS devices has increased considerably because polymers are lighter, more flexible, resistant, cheaper, and easier to process. Polymers such as polyimides, BCB, fluorocarbon polymer, and MYLAR have been used to bond wafers and fabricate 3-D polymer-based microstructures.

Wafer-to-wafer transfer technology has also attracted great attention in applications requiring integration of MEMS with IC, in MEMS packaging cost, and for batch fabrication of 3-D MEMS. In any case, the bonding and detachment of carrier wafer to and from a device wafer are key process technologies. For these purposes, many creative methods have been developed for wafer-level transfer of microstructure from one wafer to another by utilizing wax, SOI wafers, and gold tether bumping.

The following articles are related to the above:

F. Niklaus et al., "Void-Free Full Wafer Adhesive Bonding," MEMS '01, pp. 214–219, 2001;

A. Han et al., "A Low Temperature Biochemically Compatible Bonding Technique Using Fluoropolymers for Biochemical Microfluidic Systems," MEMS '00, PP. 414–418, 2000;

Y.-C. Su et al., "Localized Plastic Bonding for Micro Assembly, Packaging and Liquid Encapsulation," MEMS '01, pp. 50–51, 2001;

E.-H. Yang et al., "A New Wafer-Level Membrane Transfer Technique for MEMS Deformable Mirrors," MEMS '01, pp. 80–83; and M. Maharbiz et al., "Batch Micro Packaging by Compression-Bonded Wafer-Wafer Transfer," MEMS '99, pp. 482–485, 1999.

SUMMARY OF THE INVENTION

An object of the present invention is to provide an improved micropump assembly for a microgas chromatograph and the like.

In carrying out the above object and other objects of the present invention, a micropump assembly including a plurality of connected pump unit pairs is provided. Each of the pump unit pairs includes a pump body including a cavity formed therein. A shared pumping membrane is mounted in the body for dividing the cavity into top and bottom pumping chambers. Both of the pumping chambers are driven by the shared pumping membrane. The pump unit pairs also include a membrane drive for actuating the pumping membrane, and an individually controllable shared microvalve for controlling fluid flow between the pumping chambers. Movement of the pumping membrane and control of the shared microvalve are synchronized to control flow of fluid through the pump unit pair in response to a plurality of electrical signals.

The membrane drive may include top and bottom electrodes within the cavity for electrostatically driving the pumping membrane in response to the electrical signals.

At least one of the drive electrodes may have a curved out-of-plane surface.

At least one of the drive electrodes may be a buckled electrode.

The microvalve may be an electrostatic valve having a valve membrane disposed between top and bottom electrodes.

The top and bottom electrodes may be apertured.

The pump body may include top and bottom substrates bonded together to form the cavity therebetween.

The top and bottom substrates may be top and bottom wafers, respectively, and may be bonded by a polymer film. The polymer film may be a parylene film.

The top and bottom wafers may be bonded by a polymer film. The polymer film may be a parylene film.

The polymer film may also define the shared pumping membrane.

The pump assembly may be a peristaltic vacuum pump assembly.

The pump unit pairs may be serially connected to produce a build up of pressure sequentially along the series of pump unit pairs.

The top and bottom pumping chambers may be staggered with respect to each other.

The assembly may further include an individually controllable control microvalve for controlling fluid flow between pump unit pairs wherein control of the control microvalve is synchronized with movement of the pumping membrane and control of the shared microvalve to control flow of fluid through the pump unit pair and between pump unit pairs in response to the electrical signals.

The pumping membrane may be a polymer film.

The polymer film may be a parylene film.

Further in carrying out the above object and other objects of the present invention, in a microgas chromatograph, a micromachined vacuum pump assembly to drive a gas through the chromatograph is provided. The pump assembly includes a plurality of connected pump unit pairs. Each of the pump unit pairs includes a pump body including a cavity formed therein. A shared pumping membrane is mounted in the body for dividing the cavity into top and bottom pumping chambers. Both of the pumping chambers are driven by the shared pumping membrane. The pump unit pairs further include a membrane drive for actuating the pumping membrane, and an individually controllable shared microvalve for controlling fluid flow between the pumping chambers wherein movement of the pumping membrane and control of the shared microvalve are synchronized to control flow of fluid through the pump unit pair in response to a plurality of electrical signals.

The above object and other objects, features, and advantages of the present invention are readily apparent from the following detailed description of the best mode for carrying out the invention when taken in connection with the accompanying drawings.

BRIEF DESCRIPTION OF THE DRAWINGS

FIG. 6 is a schematic perspective view of a 4-cavity multistage micropump; the flow is from the bottom left to the top right; the locations of the pumping membranes and valves are indicated;

FIGS. 7*a*–7*d* are side schematic cross-sectional views showing the various states of operation in the multistage micropump of FIG. 6: FIG. 7*a* shows compression of bottom cavities; FIG. 7*b* shows gas transfer from bottom-to-top cavities; FIG. 7*c* shows compression of top cavities; and FIG. 7*d* shows gas transfer from top-to-bottom cavities;

FIG. 8 is a side schematic sectional view of a micropump of the present invention with a parylene membrane and bonding;

FIG. 9*a* shows full flow (open); FIG. 9*b* shows partial flow; FIG. 9*c* shows no flow (closed); and FIG. 9*d* a perspective schematic view of the microvalve;

DETAILED DESCRIPTION OF THE PREFERRED EMBODIMENTS

Figure 1A:
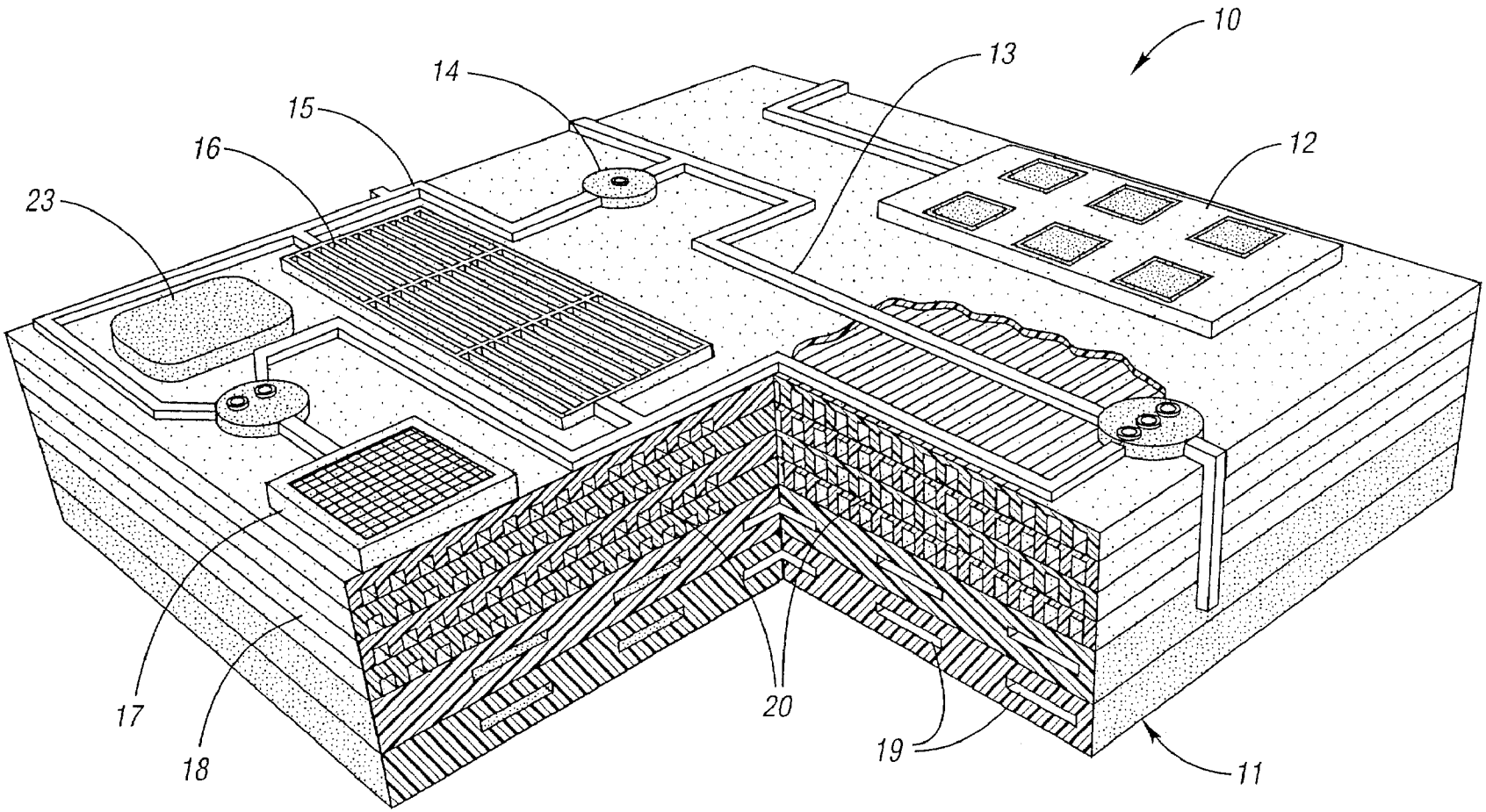
FIG. 1*a* is a schematic perspective view, partially broken away and in cross-section, of a microgas chromatograph using a micropump assembly of the present invention.

A pump assembly of the present invention is particularly useful in a microgas chromatograph, generally indicated at 10 in FIG. 1*a*. The pump assembly is generally indicated at 11. The chromatograph 10 also includes a multi-sensor array 12, sealed channel 13, a latching bypass valve 14, column vias 15, a multistage preconcentrator 16, filtered inlet 17, a calibration source 23 and a stacked DRIE $\mu$-column 18.

The pump assembly 11 includes pump vias 19 and the $\mu$-Column 18 includes polar/non-polar columns 20.

Pump Assembly Overview

Figure 1B:
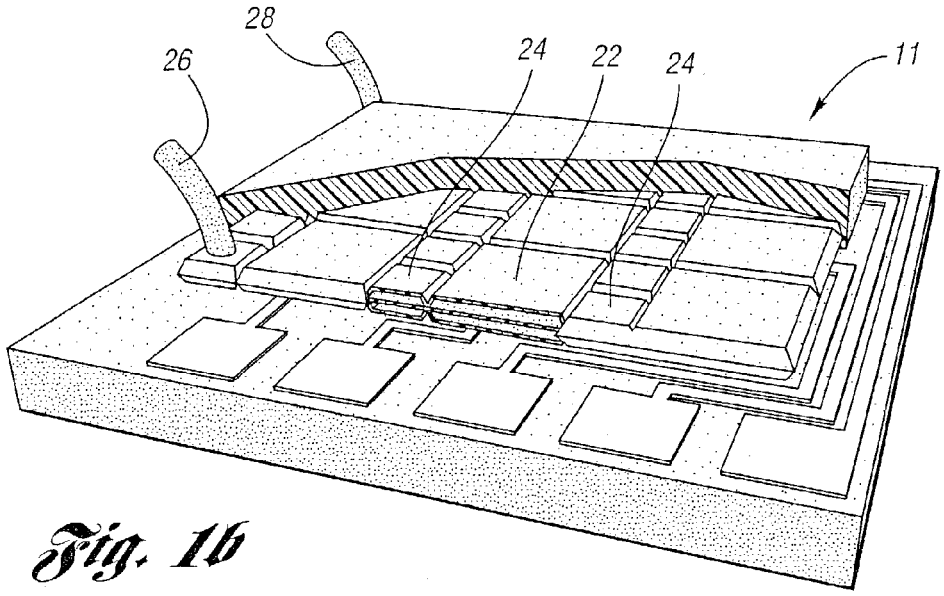
FIG. 1*b* is a schematic perspective view, partially broken away and in cross-section, of a micropump and valves of the present invention.

Referring to FIG. 1*b*, the assembly of the invention includes a micropump 22 having a series arrangement of micromachined pump cavities, connected by microvalves 24. An inlet tube 26 and an outlet tube 28 are provided. Each cavity has an inlet and outlet valve to allow gas to enter or exit during the appropriate stage of the pump cycle. The pump cavities are stacked on one another in such a way that two cavities can be driven by one pumping membrane. Each pumping stage has a small compression ratio such that each stage provides only a few percent pressure rise. The number of stages can be varied in such a way as to achieve the desired pressure rise while maintaining a small burden at each stage with compression ratio. A small compression ratio allows the work to be more evenly distributed between the stages. A large compression ratio would cause most of the pumping work to be done by the last stage.

Pumping operation is triggered electrostatically by pulling down pump and valve membranes at a certain cycle. All the pumping membranes are synchronized in movement and also each of inlet and outlet valves are. Through scheduling the electrical signal in a specific way, one can send gas in one direction or reverse. The frequency at which the pump system is driven determines the flow rate of the pump. In order to achieve high operating frequency, that is, high flow rate a push-pull design is introduced. By means of having electrodes on both sides, an electrostatically driven membrane easily overcomes mechanical limitation of vibration and damping from resistant air movement throughout holes and cavities. A curved shaped electrode is designed such that it can generate a large force utilizing so-called "zipping effect" from the edges where the distance between two plates is closest towards center.

Configuration

The assembly 11 generally includes a multistage microvacuum pump. First, the configurational uniqueness of the total microvacuum pump consists of staggered cavity arrangement for self-aligned connection of multistage pump, time scheduling of the multistage diaphragms' and valve membranes' movement, self-routed connection throughout the multistage pump unit, valve sharing structure between unit pumps, multistage formation for low compression ratio, series configuration of units for pressure build up, low volume displacement cavity, and diaphragm membrane sharing between upper and lower pump stages. Second, each pump unit's structural uniqueness comes from double-side electrodes for push-pull functionality, two wafer bonded cavity formation with parylene intermediate layer, polymer membrane utilizing same material for bonding, double-sided electrostatic valve, checker board valve shape, and curved electrodes. Finally, the novel technology developed to fabricate microvacuum pump are the buckled electrode for curved shaped surface, parylene fusion bonding, and free-standing layer formation technology.

Figure 2:
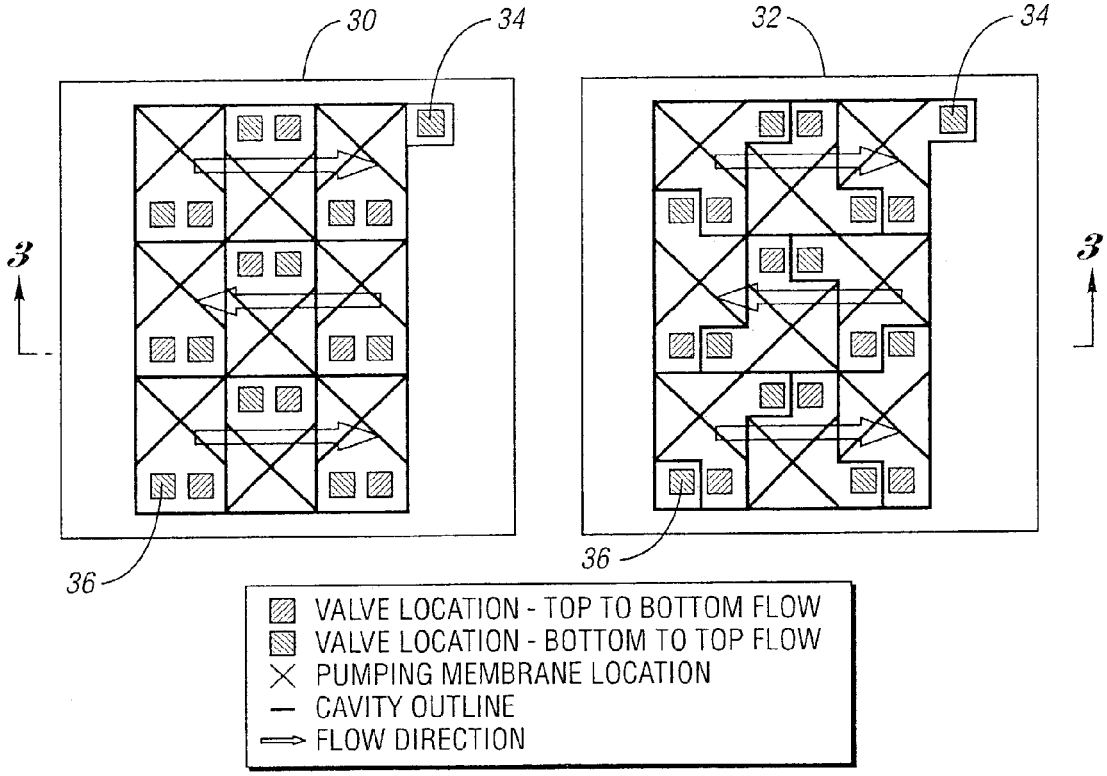
FIG. 2 is a top schematic view of a proposed lay-out of an 18-stage microvacuum pump with respect to the bottom and top wafers on the left and righthand sides of the Figure, respectively.

FIG. 2 shows the arrangement of pump cavities for the assembly 11 including a bottom wafer 30, a top wafer 32, pump outlets 34 and pump inlets 36. A pump membrane 38 is shown in FIG. 3 which is a view along lines 3—3 of FIG. 2.

Figure 3:
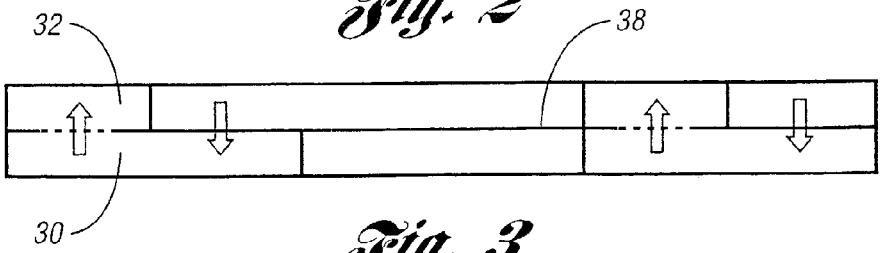
FIG. 3 is a view taken along lines 3—3 of FIG. 2 showing the flow path of the pump of FIGS. 2*a* and 2*b;*

In the implementation of FIGS. 2 and 3, pumping cavities are located on both sides of each membrane interconnected with one-way valves. The arrangement and geometry of pumping cavities is such that gas is transferred between the top-to-bottom and bottom-to-top cavities synchronously, and from the inlet to the outlet sequentially. As can be seen from FIG. 3, the inlet of the Nth stage is the outlet of the (N−1)th stage, the exceptions being the overall pump inlet and outlet. This allows minimum pressure losses due to flow passage connections between pump stages. Having the valves in this arrangement and one pump membrane for every two pump cavities allows the design to maximize its volume efficiency and minimize moving parts and signal inputs. FIG. 3 shows the flow path in cross-section. Gas is pressurized in a pump cavity and then passed upward, or downward, to the next pumping stage. This process continues, increasing the pressure of the gas until the last pumping stage exit.

Timing

Figure 4:
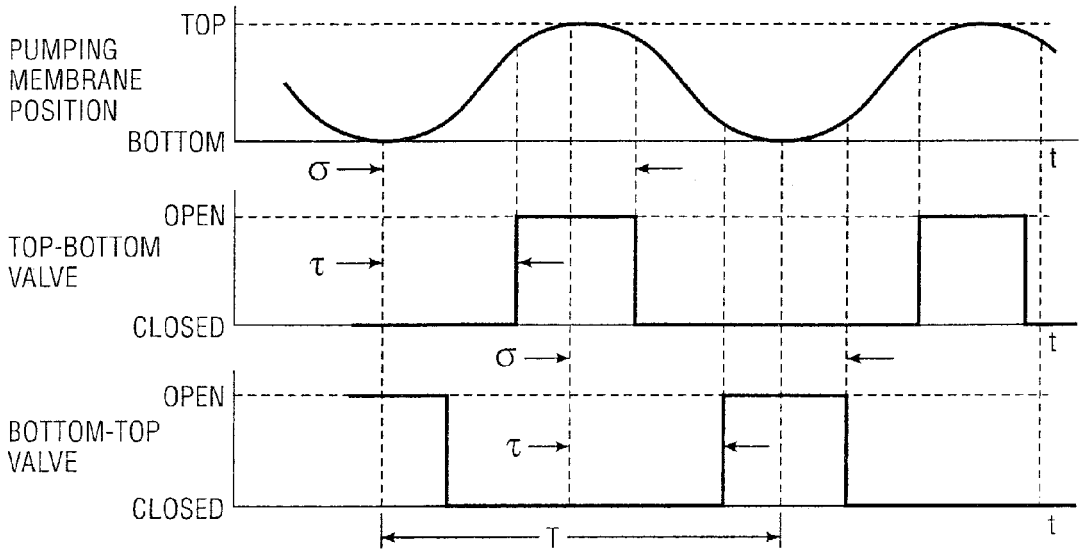
FIG. 4 is a timing diagram of the multistage micropump of the present invention; the top trace shows the position of the pumping membrane; the middle trace shows the state of the TB valves; the lower trace shows the state of the BT valves.

A timing diagram for the assembly 11 is shown in FIG. 4. There are three signals needed for the operation of the micropump:

1. Pumping membrane drive signal. This signal is the main power to the drive membranes, which are operated synchronously. It could be a sine wave or a more sophisticated waveform. As a result of the drive signal, the membrane is at the bottom position (i.e. membrane fully deflected toward the bottom wafer), the top position (i.e., membrane fully deflected toward the top wafer), or in transition between the top and bottom positions. The time evolution of the membranes' position is illustrated as the upper trace in the timing diagram of FIG. 4.

2. The top-bottom valve control signal. This signal controls the state of all the top-to-bottom flow valves. The valves must open during the bottom-to-top stroke of the membranes. The actual actuation time is delayed by a time, τ, relative to the initiation of the upward stroke of the membranes in order for the pressure in the top cavity to increase above the pressure in the following bottom cavity. The valves remain open until the pressure in the top and bottom cavities equilibrate and there is no more flow from the top to the bottom cavity. For optimum performance at high frequency, the valve may close during the top-to-bottom motion of the membrane. The top-to-bottom valve timing is shown in the timing diagram figure as the middle trace in FIG. 4.

3. The bottom-top valve control signal. This signal controls the state of all the bottom-to-top flow valves. The valves must open during the top-to-bottom stroke of the membranes. The actual actuation time is delayed by a time, τ, relative to the initiation of the downward stroke of the membranes in order for the pressure in the bottom cavity to increase above the pressure in the following top cavity. The valves remain open until the pressure in the cavities equilibrates and there is no more flow from the bottom to the top cavities. For optimum performance at high frequency, the valve may close during the bottom-to-top motion of the membrane. The bottom-to-top valve timing is shown in the timing diagram figure as the bottom trace in FIG. 4.

A volume compression ratio is a key factor determining overall operation of microvacuum pump, as can be seen in Table 1. In order to reduce electrostatic power consumption, each stage's maximum pressure drop should be minimized which, in turn, increase the number of stages. In other words, the multistage organization of the present microvacuum pump enables less voltage to be required for the same performance condition by utilizing a low compression ratio. Each pumping stage has a small compression ratio ($V_{max}/V_{min}$~1.04) such that it provides only a few percent pressure rise. A small compression ratio allows the work to be more evenly distributed between the stages. A large compression ratio would cause most of the pumping work to be done by the last stage. The number of stages can be varied in such a way as to achieve the desired pressure rise while maintaining a small compression ratio. The pump can provide the maximum pressure rise for a zero flow rate, while large flow rates mean small pressure rise. If a flow rate and pressure rise are specified, the compression ratio and number of stages can be varied to realize the desired design. If the flow rate and pressure rise are specified, but the flow rate is out of the realizable range of the pump, several pumps with the correct pressure rise can be used in parallel to achieve the desired flow rate.

TABLE 1

Relationship Between Compression Ratio and Other Factors

Lower Volume Ratio Favored → ← Higher Volume Ratio Favored

| Voltage | Maximum Pressure at Last Stage | | M | Qnorm (normalized flow rate) | Frequency (2 sccm) | Frequency (50 sccm) |
|---|---|---|---|---|---|---|
| 250.4 | 3850 | | 18 | 0.01 | 198.4 KHz | 77.9 KHz |
| 259.2 | 4310 | | 16 | 0.069 | 29.0 KHz | 76.7 KHz |
| 278.5 | 4760 | | 14 | 0.116 | 17.3 KHz | 75.4 KHz |
| 304.4 | 6100 | | 11 | 0.210 | 9.5 KHz | 73.9 KHz |

Figure 5:
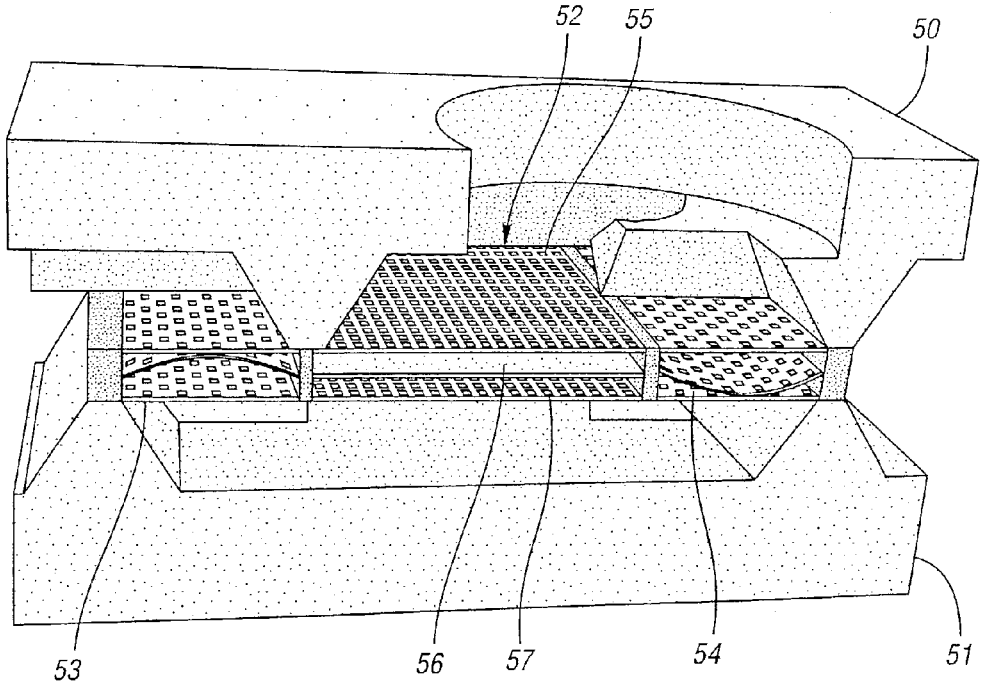
FIG. 5 is a detailed schematic perspective view, partially broken away, of two microvacuum pump units and microvalves.
Figure 9A:
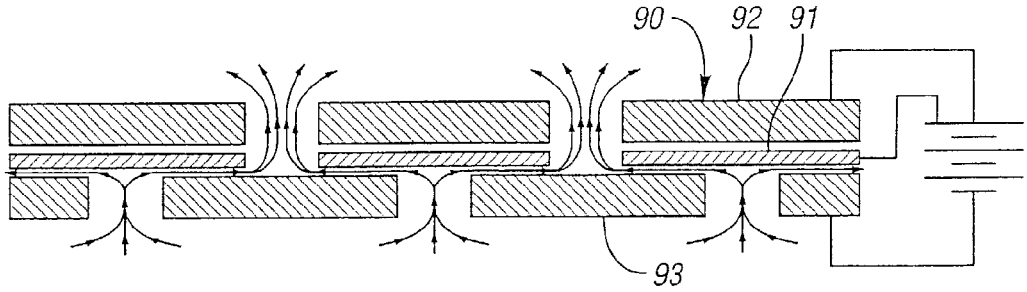
FIGS. 9*a*–9*d* are views of a microvalve structure and its flow pattern.
Figure 9B:
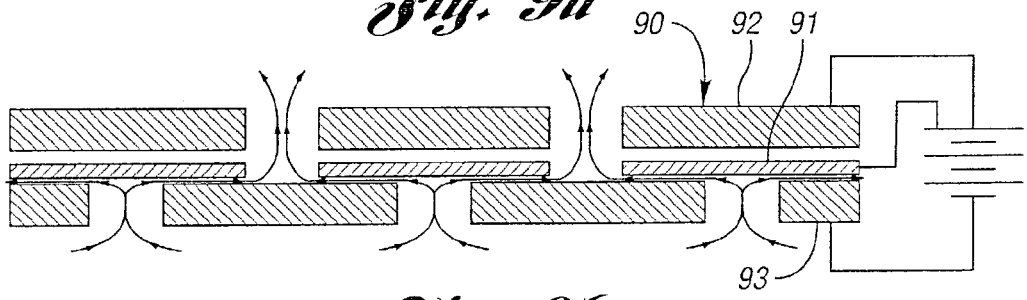
Figure 9C:
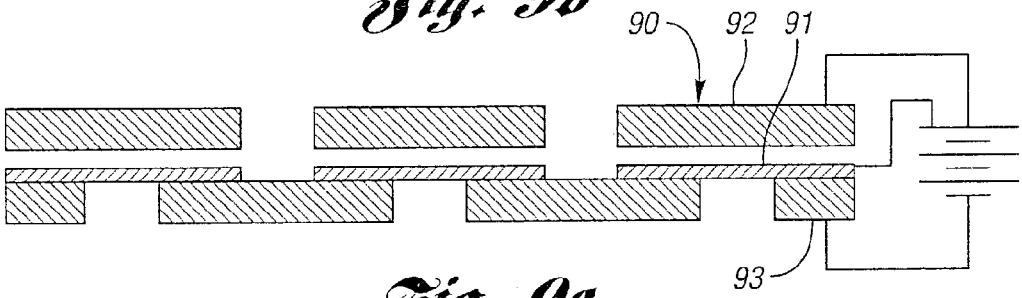
Figure 9D:
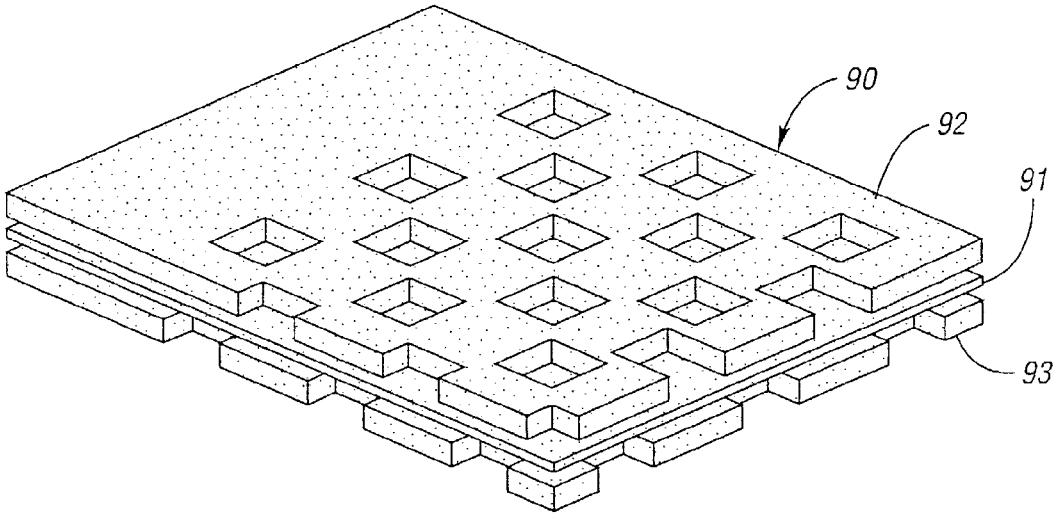

FIG. 5 shows a detailed representation of the length scales in the pump assembly. The assembly includes a top wafer 50, a bottom wafer 51, a pump, generally indicated at 52, a microvalve 53 and a microvalve 54. The pump 52 includes a top electrode 55, a membrane 56 and a bottom electrode 57. The pump cavity is large compared to the volume the membrane 56 sweeps out in its motion. This provides a small compression ratio. The small volume swept out by the membrane 56 provides displacement to drive the gas flow. The flow rate through the pump 52 is proportional to the volume displaced by the pump 52 per unit time. Thus, to obtain a large flow rate for a small volume displacement, the membrane 56 must be driven at high frequencies (typically kHz range).

As FIG. 5 shows, one unit is comprised of one diaphragm pump 52 and two input and output valve cavities. The size of the valve cavities is half the size of the pump body such that two valve units exactly can sit on the sides of the pump cavity without wasting any extra space between pumps or valves. The location of each inlet and outlet valve is staggered in such a way that the outlet of the previous stage is automatically connected to the inlet of the next stage pumps without any extra connection areas.

FIG. 5 shows the detailed configuration of unit stage micropump and valves. The lower cavity forms first pump and the upper cavity forms second pump unit. The diaphragm or membrane 56 between two cavities works as an air-compressing membrane for both pumps. For example, when the diaphragm or membrane 56 comes down, it compresses air out of the lower pump chamber, and at the same time inflates air into the upper pump chamber.

In order to increase the frequency of membrane operation, a push-pull design is introduced. So far, the electrostatic device has been dependent on the restoring force caused by the membrane tension for high-speed vibration. However, the existing method has a limitation due to the mechanical property of the membrane and also the resonance frequency of the cavity covering air movement volume. Therefore, this double-sided electrode helps microvacuum pump operate at much higher frequency.

Operation of the Multistage Pump

Referring now to FIGS. 6 and 7*a–d*, as the name implies, a multistage micropump consists of a large number of pumping cavities arranged in series as illustrated in FIG. 6 for a 4-stage pump. The pumping cavities are driven by electrostatically-actuated membranes 60 and are interconnected by electrostatically-driven checkerboard microvalves 62 and 64. Two features of the design minimize the force acting on the membrane 60. The compression ratio of the pumping cavities is almost one, thus minimizing the increase in pressure for each pumping stage, and each membrane drives adjacent pumping cavities, minimizing the pressure differential across the membrane 60. The cavities are operated synchronously in series, thus even though each pumping cavity produces a small increase in pressure, the combined effect of all the cavities results in a large pressure rise for the entire pump. The microvalve layout is also shown in FIG. 6. The top-to-bottom (TB) valves 62 connect the cavities on either side of the same membrane. The bottom-to-top (BT) valves 64 connect bottom cavities to the following top cavities. TB microvalves and BT microvalves are each operated synchronously. In order to obtain large flow rates, the membranes are operated at high frequency. Typical operating frequency of MACE membranes is 70 kHz, although lower frequencies are likely to be used for micropump applications.

The operation of the pump is illustrated in FIGS. 7*a*–7*d* and FIG. 4. Various intermediate states of the pump are shown in FIGS. 7*a*–7*d*, and the timing diagram is shown in FIG. 4. The operation of the pump can be divided into two cycles, a "gas pumping" cycle and a "gas transfer" cycle. Starting with the membrane near the top, with all the valves closed, as the membrane moves down (FIG. 7*a*), the pressure in the bottom cavities increase and the pressure in the top cavities decrease. When the pressure in the bottom cavities reach the value in the next cavity, the BT valves open. At this point, further downward motion of the membranes will transfer gas from the bottom to the top cavities. This is the first gas transfer cycle shown in FIG. 7*b*. When the gas flow in the BT valves stops, all the valves close and a new pumping cycle begins (FIG. 7*c*). During the upward motion of the membranes, the pressure in the top cavities increase and the pressure in the bottom cavities decrease. When the pressure difference between the top and bottom cavities for each membrane is approximately zero, the TB valves open and a new gas transfer cycle begins (FIG. 7*d*). This time, ,gas transfer occurs between the top and bottom cavities on either side of each membrane. The transfer cycle ends when the gas flow in the TB valves stops and the TB valves close.

The flow rate and pressure rise of the pump is determined by the relative duration of the gas pumping cycle and the gas transfer cycle, which is characterized by the ratio of the valve opening delay time and the valve closing delay time, to the period of the membrane motion T. These parameters are optimized depending on the required pressure rise and flow rate as well as the operating frequency of the pump. The pump flow rate is maximized and the pressure rise is very small when the valves open time (Z 'Δ is approximately equal to one-half the period of the membrane motion T) because pumping occurs over a very short time. In this case, the pump operates as a peristaltic pump. As the valve opening time delay is increased, the duration of the pumping cycle is increased and, therefore, the pressure rise increases and the flow rate decreases. The maximum pressure rise is obtained when the valves open time (Z 'Δ is small compared to the period of the membrane motion T). which also corresponds to zero flow rate.

Electrostatic actuation is used to drive the membranes. The electrostatic pressure needed to move the membrane is that needed to overcome the gas pressure and the structural residual tension. During the gas transfer cycles (FIGS. 7*b* and 7*d*), the pressure difference across the membrane is caused by pressure losses in the valves and electrode perforations. These processes will always result in energy loss and increased power consumption. It is therefore important to minimize pressure losses in the valves and the electrode perforations. However, during the pumping cycles, the pressure difference across the membrane depends on the direction of motion. For a downward motion (FIG. 7*a*), the pressure in the bottom cavity is higher than the pressure in the top cavity and therefore the gas pressure force opposes the motion of the membrane. Consequently, much larger power consumption is expected in this part of the pumping cycle. In contrast, during the upward motion of the membrane, the gas pressure force across the membrane is in the same direction as the motion and therefore some energy recovery is possible during this part of the cycle. These considerations suggest that the present design should result in reasonable low power consumption.

By offering the same material as diaphragm membrane and bonding, the process is simplified dramatically. FIG. 8 shows how two wafers 80 and 81 are stacked up in order to form double side electrodes 82 and 83 and two pump cavities without spending extra space. Here, parylene is conformally deposited on all wafer surfaces so that it provides a good dielectric between two electrodes 82 and 83 at the same time being a part of the membrane 84. In this way, parylene simultaneously works as dielectric to prevent electrical short, membrane protection layer, and bonding material. By means of heating up parylene more than glass transition temperature, but less than melting point, a parylene membrane being protected from deformation can activate its polymer chains for bonding. Parylene fusion bonding has been performed and resulted in excellent strength in pull-in test.

The microvalve structure and a flow diagram are shown in FIGS. 9*a*–9*d*. A valve, generally indicated at 90, is based on a "checkerboard" arrangement of the membrane 91 and electrodes 92 and 93. This arrangement allows the gas to flow through the bottom electrode holes, through the bottom electrode/membrane gap, and out through the membrane and top electrode hole. The valve is closed when the membrane is electrostatically forced onto the bottom electrode, closing off the flow path. The bottom electrode/membrane gap acts as a sealing area to prevent leakage flow. This gap also provides the top electrode/membrane electrostatic attraction area. A double side electrodes structure adds its uniqueness, letting membrane response time shorter and have better sealing. A double electrode allows a push-pull force for the membrane. The top electrode also prevents the membrane from bowing or buckling outward under the force of the flow. The membrane itself is a metal coated on both sides by parylene to prevent electrode contact and to provide good mechanical properties.

The hole, gap, and thickness sizes of the valve 90 can be varied in such a way to obtain a desired pressure drop. In the micropump application, holes are arranged to provide a minimum pressure drop. The current pump is expected to have valves with pressure losses on the order of a few thousand pascals.

The curved electrodes 82 and 83 of FIG. 8 have one of key roles overcoming the limitations of electrostatic devices because the curved shape can generate a large force utilizing the so-called "zipping effect" from the edges where the distance between two plates is closest. As the "zipping" propagates from the edges to the middle, the distance is kept smaller so that the required voltage to pull down a membrane can be minimized. The effectiveness of the curved electrode has been proven in reducing required voltage from simulation. With the same gap at the center, the curved electrode deflects the membrane at least 5 times more than the normal flat electrode. This curved electrode is expected to provide larger volume displacement rate, simultaneously reducing electrostatic power consumption in the micro-vacuum pump assembly of the present invention.

Curved Electrode

Figure 10:
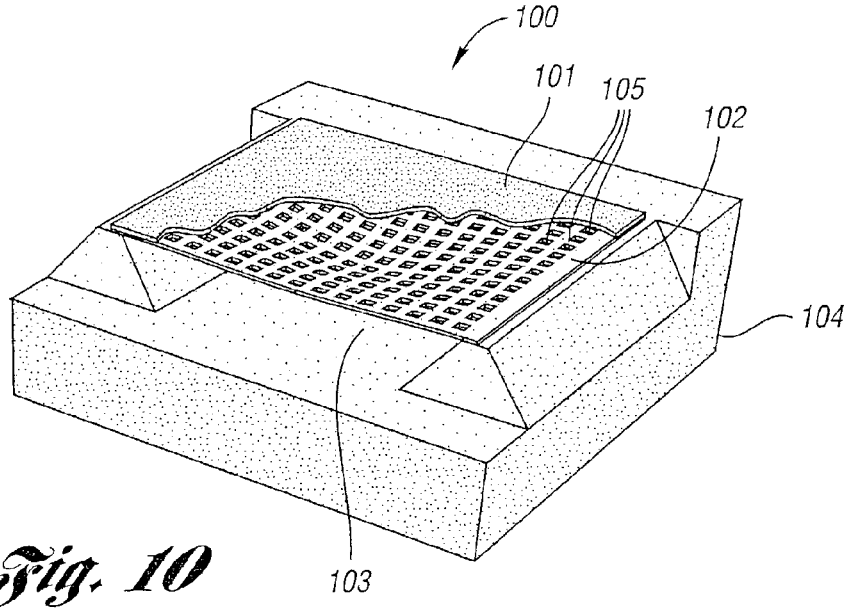
FIG. 10 is a perspective schematic view, partially broken away, of a buckled electrode actuator where the curved electrode reduces pull-in voltage and was formed by stress-engineered composite layers and a free-standing membrane was attached over the electrode without stiction by a parylene membrane transfer technique.
Figure 11A:
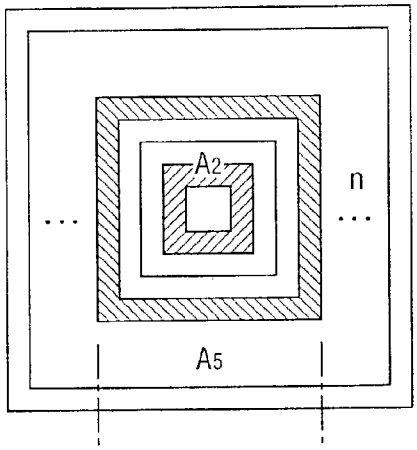
FIGS. 11*a* and 11*b* are top and side schematic views, respectively, of a simplified curved electrode; the curvature of the structure can be changed by using different values of n.
Figure 11C:
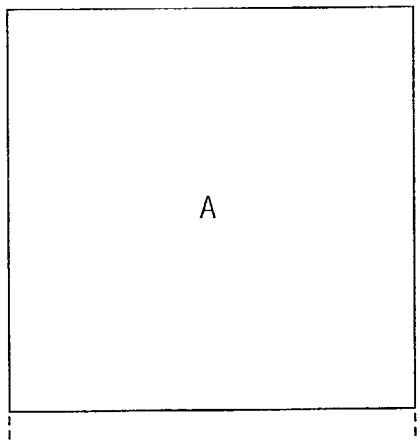
FIGS. 11*c* and 11*d* are top and side schematic views, respectively, of a flat electrode.
Figure 11B:
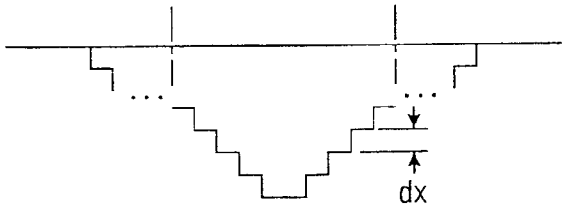
Figure 11D:
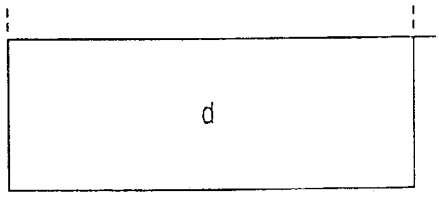

An electrostatic actuator has been fabricated and used to form a large -deflection electrostatic actuator, as shown in FIG. 10 at 100. The actuator or pump 100 includes a transferred parylene membrane 101 and a buckled electrode 102 suspended in a wet etched cavity 103 formed in a substrate 104. The electrode 102 has perforated holes 105 to reduce clamping.

Capacitive parallel-plate electrostatic devices for large deflection require a low pull-in voltage that is determined by the air gap between two conductive plates. In varying gap mode operation, a higher force can be generated when the actuator has a larger plate area or a smaller gap between electrodes. Since the force increases more strongly with decreasing gap than with increasing area, the control over gap becomes more critical in deciding the electrostatic operation voltage as in Equation (1):

$$F_e = \frac{1}{2}V^2\frac{\partial C}{\partial x} = \frac{\varepsilon A}{2d^2}V^2 \tag{1}$$

A parallel plate structure with smaller gaps close to the edges and a larger gap close to the center of the movable electrode can produce higher electrostatic force at the edges, where the distance between plates is small, to pull the movable opposite diaphragm down to the fixed electrode. The curved structure's effectiveness can be shown in a simplified structure, as shown in FIGS. 11*a*–11*d*. A curved structure is assumed to have a number, n, of steps and the same number of steps in both the vertical and horizontal for calculation simplicity; n can increase to infinity to achieve a more smooth structure. From FIGS. 11*a*-11*d*, the force produced by the curved electrode can be approximated as the sum of forces generated by each region:

$$F_{Curved} = -\frac{\varepsilon V^2}{2}\frac{A}{gap^2} = -\frac{\varepsilon V^2}{2}\left(\sum_{K=1}^{n}\frac{A_k}{dx_k^2}\right)$$

$$F_{Flat} = -\frac{\varepsilon V^2}{2}\left(\sum_{k=1}^{n}\frac{A_k}{d^2}\right)$$

Therefore, $$\begin{aligned} F_{Curved} &= \frac{\varepsilon V^2}{2}\left(\sum_{k=1}^{n}\frac{\{2n-2k+2\}^2-\{2n-2k\}^2}{k^2}\right) \\ &= \frac{\varepsilon V^2}{2}\left(\sum_{k=1}^{n}\frac{-8k+kn+4}{k^2}\right) \\ &\geq \frac{\varepsilon V^2}{2}\left(\frac{8n+4}{1}\right)_{\text{when_k=1}} \\ &\geq 4 = \frac{2n\times 2n}{n^2} = F_{Flat} \end{aligned}$$

Thus, the force that a curved structure provides is always higher than that of a flat electrode and the effectiveness of the curved structure becomes higher as n increases, resulting in reduction of pull-in voltage with smoother sidewall slope.

Buckled Electrode

A simple and one-mask fabrication technique utilizing buckling of a stand-alone membrane under the compressive stress of thin films has been developed to construct a curved structure. This approach is much simpler (one-mask) than those reported previously, as described in FIGS. 12*a*–12*c*. In addition, it needs not be controlled accurately, for example during etching or patterning. Further, the stress in the flat structure can be controlled to buckle it to a certain center deflection and buckling direction.

Figure 12A:
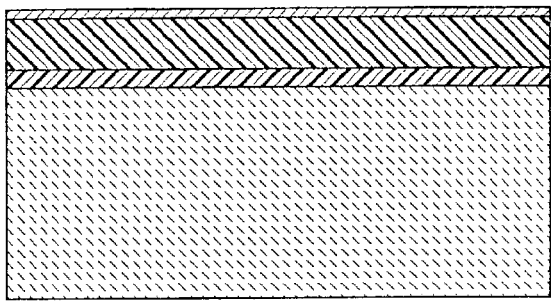
FIGS. 12*a*–12*h* are side sectional schematic views illustrating an electrostatic buckled electrode actuator fabrication process flow including a membrane transfer and bonding technique utilizing parylene and self-built curved electrode formation by stress-engineered thin films.

FIG. 12*a* shows oxide/CVD polysilicon/nitride deposition.

Figure 12B:
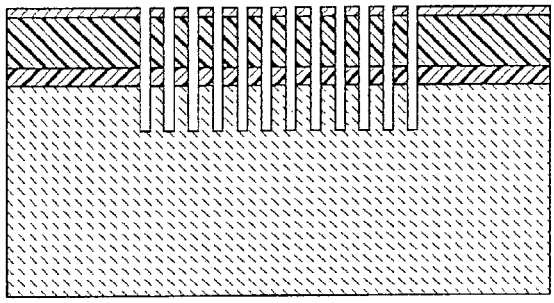

FIG. 12*b* shows DRIE etch through to the silicon wafer.

Figure 12C:
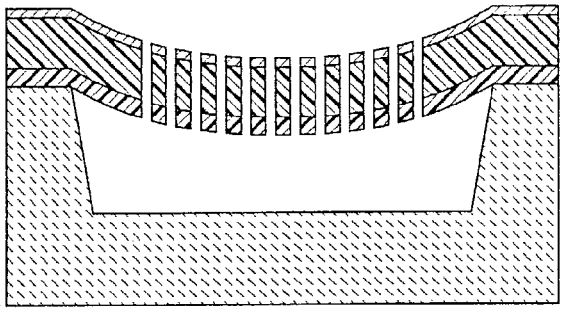

FIG. 12*c* shows isotropic TMAH silicon etch wherein buckling forms a curved electrode.

Originally, true pure-buckling on a silicon wafer was achieved by introducing compressive stress over the critical value (~11 MPa resultant stress from the composite polysilicon/oxide layer in total) to cause buckling of the thin membrane electrode. As shown by Equation (2), the critical stress for buckling in a clamped diaphragm is mainly determined by Young's modulus, E, and thickness, t, of the composite thin films.

$$\sigma_{X_crit} + \frac{a^2}{b^2}\sigma_{Y_crit} = 1.1\frac{Et^2a^2}{1-\nu^2}\left(\frac{3}{a^4}+\frac{3}{b^4}+\frac{2}{a^2b^2}\right) \tag{2}$$

The electrodes fabricated utilizing buckling of stressed thin films after wet-etching undercut was released showing 274 of 544 stressed diaphragms buckling up and the other 50% buckling down. In order to obtain directionality from pure buckling (i.e., provide a preference to the buckling direction), a strong tensile silicon nitride layer was deposited on top of the previous composite layers and released. In the final design, 100% of the electrodes were successfully buckled down.

Simulation was performed to measure the structural strength of this buckled electrode. In order to obtain the desired buckling depth, the buckled electrode cannot be too thick. However, this electrode must be stiff enough to resist deflection in the vertical direction under applied force. ANSYS simulations show that the curved electrode of the final design with 18.66 μm under 6000 Pa; a flat electrode modes more than a few microns.

In the final design, a combination of 0.5 μm thermal oxide, boron-doped LPCVD polysilicon (3.8 μm), and thin silicon nitride (0.1 μm) for directionality of buckling were deposited, patterned (perforated to reduce damping) to form the bottom electrode, and the silicon underneath is wet-etched, thus allowing it to buckle under the intrinsic compressive stress. All of the flat electrodes buckled down after release by an average 18.7 μm (across wafer nonuniformity of 3%) and showed an excellent smooth profile following a 3.3-order sinusoidal curvature near the edges, which is desirable for low pull-in voltage.

A 1.5 μm freestanding and flat parylene membrane was transferred on top of the curved electrode, thus alleviating the complexities created by processing on a non-flat surface after the drive electrode is buckled, as shown in FIGS. 12*d*–12*h*.

Figure 12D:
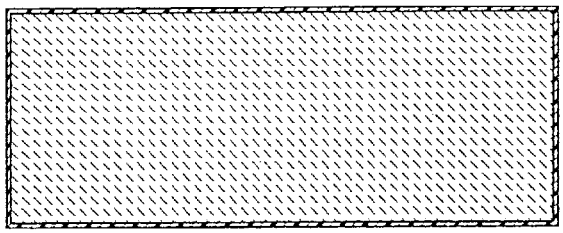

FIG. 12*d* shows photoresist spinning/parylene deposition.

Figure 12E:
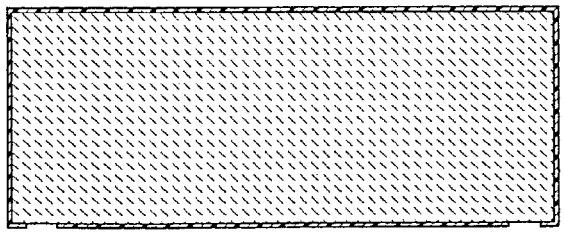

FIG. 12*e* shows photoresist release through etch hole.

Figure 12F:
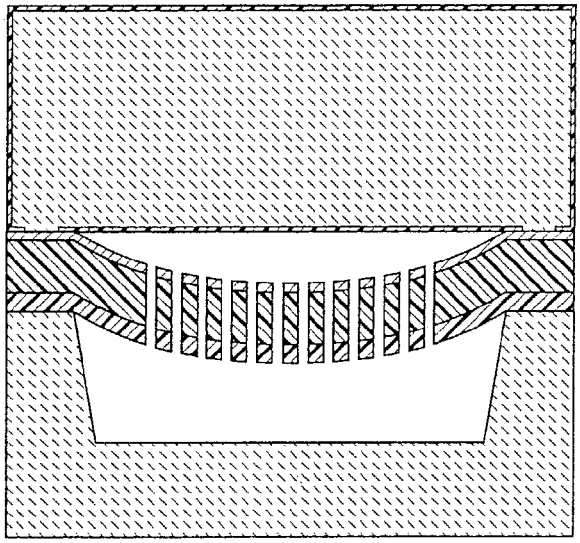

FIG. 12*f* shows parylene bonding.

Figure 12G:
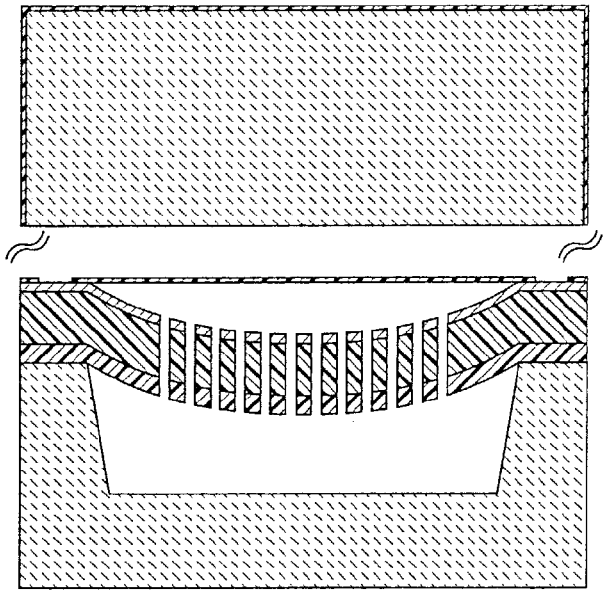

FIG. 12*g* shows parylene membrane transfer by detaching a carrier wafer from a device wafer.

Figure 12H:
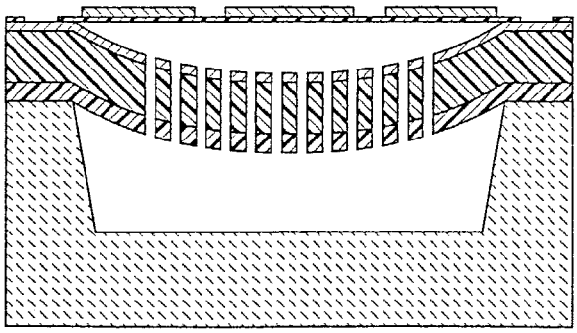

FIG. 12*h* shows aluminum deposition and its patterning on top of the transferred membrane.

The importance of a smoothly curved surface has been emphasized especially in electrostatic actuators. As one alternative method to achieve a curved surface, a novel technology of utilizing natural buckling effect of stressed thin film layers have been developed. This selected technology shows the possibility of reliable and simple manufacture of an under-etched curved membrane with less complex fabrication processes. By combining differently stressed layers of polysilicon, oxide, nitride, and silicon substrate, a target buckling depth has been accomplished.

Theoretically, the ideal surface configuration for an electrostatic device is higher order sinusoidal such that it can minimize the pull-in voltage and plate bending stress along the surface, while increasing volume displacement by deflected membrane. A normalized curvature from the fabricated electrodes is a symmetric and high-ordered, 3.3 sinusoidal curve is achieved at the edges.

A novel bonding technology has been developed utilizing a parylene intermediate layer. This technique has great advantages over anodic and eutectic bonding in terms of its simplicity. Especially because parylene is also one material that comprises of diaphragm and valve membrane in micro-vacuum pump, no additional effort to provide a bonding layer is needed.

In order to utilize parylene as a wafer bonding material, chemical analysis on parylene-C powder (pre-deposition) and thin parylene film (post-deposition) was first performed with DSC2100 (Differential Scanning Calorimeter). This experiment monitors the emission of heat from parylene during heating from room temperature through glass transition point up to melting temperature. It was found that there was no chemical reaction during the heating or cooling process except at glass transition point (109.4° C.) and melting temperature (300° C.), which implies that wafer bonding utilizing an intermediate layer of parylene occurs by the physical movement of polymer chains, not by their chemical reactions. Thus, parylene bonding requires direct contact and heat that enables polymer chain's movement and its crosslinking.

Parylene bonding (P-bonding) was characterized and performed between combinations of glass and silicon wafers under various conditions including temperature, vacuum, and bonding time to determine the optimum bonding recipe. A series of tests was performed with an applied 800N force across a 4" wafer surface in a vacuum of $1.5*10^{-4}$ Torr. During tests, P-bonding utilized only a 381 nm thin parylene film on each wafer and lasted 30 minutes with direct contact between the carrier wafer and the device wafer.

In order to optimize the bonding temperature, a series of P-bonding tests was performed under different bonding temperatures. The bonded wafers were diced into 2 cm×2 cm square samples and attached to metal holders for pull-in test where the attached two wafers were pulled apart until the pieces were separate. This bonding strength measurement was performed using an Instron Pull-Test machine. The bonding strength increases proportionally with bonding temperature above glass transition point and leveled off at 3.6 MPa near 230° C., which is determined as the optimum bonding strength and temperature. The optimized bonding temperature and strength were used for parylene bonding and membrane transfer technology conditions. It was found during the P-bonding process, the intermediate parylene layer contracted by a small amount from 762 nm to 600 nm, about 79% of the original thickless. The post-bonding parylene thickness was uniform within ±74 run in that specific case over a large measured area of 100 $\mu$m at bonding surface.

Compared with other traditional bonding methods, the P-bond is certainly useful in MEMS because of its simple, low-temperature, low-stress, biocompatible characteristics as well as acceptable bonding strength, 3.6 MPa that correspond to the bonding strength of a soft solder. Considering the pull-test sample had a square shape where bonding cracks easily propagate faster from each of four edges due to the structural stress concentration, the actual bonding strength of P-bonding may be higher than the result achieved from this experiment.

In addition to using parylene for wafer bonding, parylene was used to form a freestanding thin parylene membrane can be transferred to a second device wafer. FIGS. 13*a*–13*g* show the process flow of the new freestanding parylene membrane transfer technique based on P-bond discussed previously.

Figure 13A:
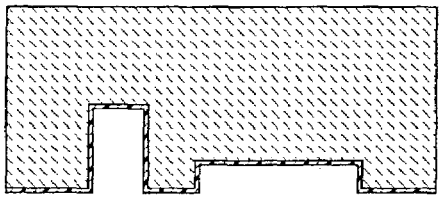
FIGS. 13*a*–13*g* are side sectional schematic views illustrating a process flow of a wafer-level parylene membrane transfer technology for a micro-fluidic device utilizing parylene bonding.

FIG. 13*a* shows RIE of random shape and depth trenches/parylene deposition as bonding layer.

Figure 13B:
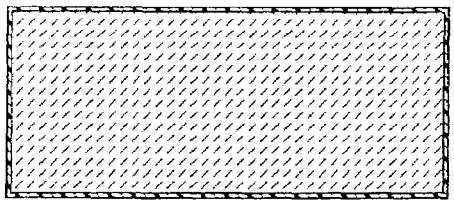

FIG. 13*b* shows photoresist sacrificial layer/parylene deposition as transfer membrane.

Figure 13C:
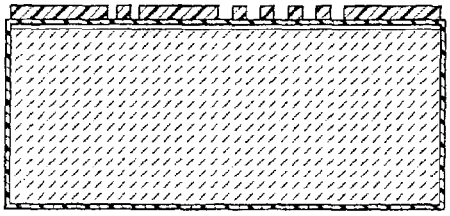

FIG. 13*c* shows lithography for parylene membrane patterning.

Figure 13D:
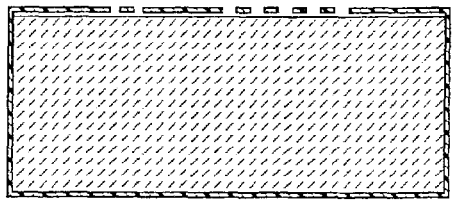

FIG. 13*d* shows photoresist strip and membrane release.

Figure 13E:
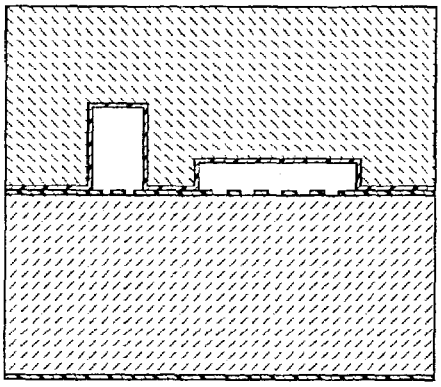

FIG. 13*e* shows aligned parylene intermediate layer bonding.

Figure 13F:
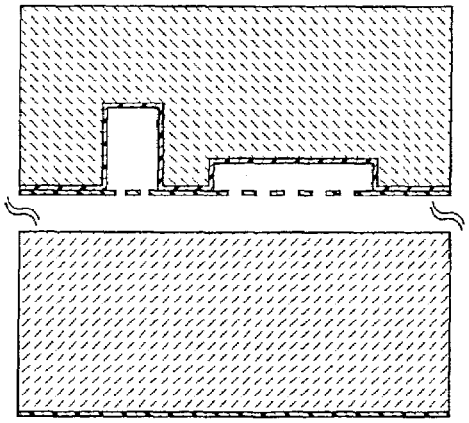

FIG. 13*f* shows parylene membrane transfer by detaching a carrier wafer from a device wafer.

Figure 13G:
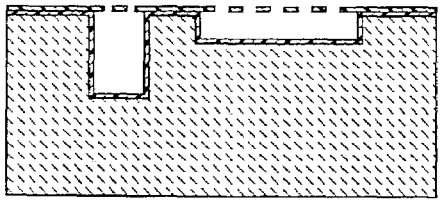

FIG. 13*g* shows complete transferred parylene membrane with/without patterns over any shape or area trenches without stiction.

First, the unpolished (back) side of the carrier wafer is coated with parylene-C after spinning a sacrificial photoresist AZ1813 (1.3 $\mu$m). This parylene becomes the membrane to be transferred. Then, photoresist is removed through etch channels formed around the perimeter of the wafer in acetone. This completely releases the parylene layer over the entire 4" silicon wafer which is attached to the wafer only around the perimeter. This wafer with the released parylene layer is now bonded to a device wafer using the parylene bonding process described above. The carrier wafer is then pulled back, leaving the parylene membranes attached to the device wafer. The unpolished side of a silicon carrier wafer was selected for membrane formation because of the rough surface profile. The backside roughness is ~2 $\mu$m, while the frontside surface roughness is a few hundred angstroms. The roughness of the wafer's backside simplify the release and detachment of the membrane from the carrier wafer. The photoresist sacrificial layer reduces the roughness of the wafer surface and results in a smooth parylene layer.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A micropump assembly including a plurality of connected pump unit pairs, each of the pump unit pairs including:

a pump body including a cavity formed therein;

a shared pumping membrane mounted in the body for dividing the cavity into top and bottom pumping chambers wherein both, of the pumping chambers are driven by the shared pumping membrane;

a membrane drive for actuating the pumping membrane; and an individually controllable shared microvalve for controlling fluid flow between the pumping chambers wherein movement of the pumping membrane and control of the shared microvalve are synchronized to control flow of fluid through the pump unit pair in response to a plurality of electrical signals.

2. The assembly as claimed in claim 1, wherein the membrane drive includes top and bottom electrodes within the cavity for electrostatically driving the pumping membrane in response to the electrical signals.

3. The assembly as claimed in 2, wherein at least one of the drive electrodes has a curved out-of-plane surface.

4. The assembly as claimed in claim 2, wherein at least one of the drive electrodes is a buckled electrode.

5. The assembly as claimed in claim 1, wherein the microvalve is an electrostatic valve having a valve membrane disposed between top and bottom electrodes.

6. The assembly as claimed in claim 5, wherein the top and bottom electrodes are apertured.

7. The assembly as claimed in claim 1, wherein the pump body includes top and bottom substrates bonded together to form the cavity therebetween.

8. The assembly as claimed in claim 7, wherein the top and bottom substrates are top and bottom wafers, respectively.

9. The assembly as claimed in claim 7, wherein the top and bottom substrates are bonded by a polymer film.

10. The assembly as claimed in claim 9, wherein the polymer film is a parylene film.

11. The assembly as claimed in claim 8, wherein the top and bottom wafers are bonded by a polymer film.

12. The assembly as claimed in claim 11, wherein the polymer film is a parylene film.

13. The assembly as claimed in claim 9, wherein the polymer film also defines the shared pumping membrane.

14. The assembly as claimed in claim 13, wherein the polymer film is a parylene film.

15. The assembly as claimed in claim 11, wherein the polymer film also defines the shared pumping membrane.

16. The assembly as claimed in claim 15, wherein the polymer film is a parylene film.

17. The assembly as claimed in claim 1, wherein the pump assembly is a peristaltic vacuum pump assembly.

18. The assembly as claimed in claim 1, wherein the pump unit pairs are serially connected to produce a build up of pressure sequentially along the series of pump unit pairs.

19. The assembly as claimed in claim 1, wherein the top and bottom pumping chambers are staggered with respect to each other.

20. The assembly as claimed in claim 1, further comprising an individually controllable control microvalve for controlling fluid flow between pump unit pairs wherein control of the control microvalve is synchronized with movement of the pumping membrane and control of the shared microvalve to control flow of fluid through the pump unit pair and between pump unit pairs in response to the electrical signals.

21. The assembly as claimed in claim 1, wherein the pumping membrane is a polymer film.

22. The assembly as claimed in claim 21, wherein the polymer film is a parylene film.

23. In a microgas chromatograph, a micromachined vacuum pump assembly to drive a gas through the chromatograph, the pump assembly including a plurality of connected pump unit pairs, each of the pump unit pairs including:

a pump body including a cavity formed therein;

a shared pumping membrane mounted in the body for dividing the cavity into top and bottom pumping chambers wherein both of the pumping chambers are driven by the shared pumping membrane;

a membrane drive for actuating the pumping membrane; and an individually controllable shared microvalve for controlling fluid flow between the pumping chambers wherein movement of the pumping membrane and control of the shared microvalve are synchronized to control flow of fluid through the pump unit pair in response to a plurality of electrical signals.

* * * * *